US009697685B1

(12) United States Patent
Al-Saleh

(10) Patent No.: US 9,697,685 B1
(45) Date of Patent: Jul. 4, 2017

(54) MOBILE DEVICE-ENABLED PORTABLE REWARD DISPENSING MACHINE

(71) Applicant: Ahmad A. Al-Saleh, Safat (KW)

(72) Inventor: Ahmad A. Al-Saleh, Safat (KW)

( * ) Notice: Subject to any disclaimer, the term of this patent is extended or adjusted under 35 U.S.C. 154(b) by 0 days.

(21) Appl. No.: 15/259,014

(22) Filed: Sep. 7, 2016

(51) Int. Cl.
*G07F 17/32* (2006.01)
*G07F 11/44* (2006.01)
*G07F 11/00* (2006.01)

(52) U.S. Cl.
CPC ..... *G07F 17/3244* (2013.01); *G07F 17/3218* (2013.01); *G07F 17/3253* (2013.01); *A63F 2250/14* (2013.01); *A63F 2250/144* (2013.01); *G07F 11/005* (2013.01); *G07F 11/44* (2013.01); *G07F 17/3225* (2013.01)

(58) Field of Classification Search
CPC .. A63F 2250/14; A63F 2250/144; A63F 9/30; G07F 17/3253; G07F 11/02; G07F 11/005
USPC ..... 463/46; 273/144 R, 144 A, 144 B
See application file for complete search history.

(56) References Cited

U.S. PATENT DOCUMENTS 2,233,589 A * 3/1941 Dean ..... G07C 15/001 273/144 B
4,786,056 A * 11/1988 Dunnigan ..... G07C 15/001 273/144 A
4,822,048 A * 4/1989 Axup ..... G07C 15/001 273/144 B
4,863,054 A * 9/1989 Capetta ..... B65D 43/162 220/4.23
4,887,816 A * 12/1989 Hanna ..... G07C 15/001 273/144 A
4,976,440 A * 12/1990 Faith ..... A63F 9/30 221/2
5,344,199 A * 9/1994 Carstens ..... G07F 17/32 273/139
5,513,853 A 5/1996 Crompton et al.
5,704,612 A * 1/1998 Kelly ..... A63B 63/08 273/352
5,711,530 A * 1/1998 Lewis ..... A63F 9/30 273/448
5,848,935 A * 12/1998 Noell ..... G07F 17/3253 221/121
6,015,344 A * 1/2000 Kelly ..... A63F 3/081 463/16
6,080,061 A * 6/2000 Watanabe ..... G07F 17/3202 273/144 R (Continued)

*Primary Examiner* — William H McCulloch, Jr.
(74) *Attorney, Agent, or Firm* — Richard C. Litman

(57) ABSTRACT

The mobile device-enabled portable reward dispensing machine is a portable reward or gift-dispensing machine (i.e., hardware) controlled by two smart phone or tablet apps/software. The integrated system is designed to reward the players of a game with gifts awarded to that specific player as a result of their game play. A dispenser is loaded with reward gifts that are capable or being dispensed through a vending or exit port under control of the two apps. The dispenser includes a microcontroller unit integrated into the dispenser and two sensors. A first of the two sensors ensures the presence of gifts within the dispensing unit available for use, while the second sensor ensures that no reward gifts are stuck on the exit door or chute. The dispenser is Wi-Fi- or Bluetooth enabled, with direct connection to the two phone apps. The two apps work independently to assist in proper reward gift dispensing.

6 Claims, 10 Drawing Sheets

(56) References Cited

U.S. PATENT DOCUMENTS 6,695,698 B1 * 2/2004 Anghelo ..... G07F 17/32 221/163
6,739,475 B2 * 5/2004 San Martin ..... G07F 17/0071 220/4.23
6,770,001 B1 * 8/2004 Shoemaker, Jr. ..... A63F 9/30 273/448
7,258,610 B2 * 8/2007 Seelig ..... G07F 17/3202 273/138.2
7,516,831 B2 * 4/2009 Chang ..... G07F 1/041 194/344
7,547,018 B2 * 6/2009 Lin ..... G07C 15/001 273/144 A
7,549,646 B2 * 6/2009 Yumiya ..... A63F 9/00 273/447
7,699,316 B2 * 4/2010 Seelig ..... G07F 17/32 273/138.2
7,727,065 B2 * 6/2010 Seelig ..... G07F 17/3213 273/138.2
7,775,521 B1 * 8/2010 Itkis ..... G07C 15/001 273/144 B
7,841,599 B2 * 11/2010 Todokoro ..... A63F 9/30 273/440
7,900,929 B2 * 3/2011 Takasugi ..... A63F 9/30 273/447
8,210,538 B2 * 7/2012 Shoemaker, Jr. ..... A63F 9/30 273/148 R
8,235,388 B1 * 8/2012 Itkis ..... G07C 15/001 273/138.2
8,448,948 B1 * 5/2013 Shoemaker, Jr. ..... A63F 9/0079 273/447
8,579,733 B2 * 11/2013 McGrath ..... A63F 9/30 473/447
8,585,057 B2 * 11/2013 Wang ..... A63F 9/30 273/454
8,678,395 B2 * 3/2014 Shoemaker, Jr. ..... F41J 5/24 273/454
8,936,173 B2 * 1/2015 Fleishman ..... G07F 11/28 221/24
9,526,978 B1 * 12/2016 Shoemaker, Jr. ... G07F 17/3209
9,539,496 B1 * 1/2017 Shoemaker, Jr. ..... A63F 9/30
9,552,685 B1 * 1/2017 Itkis ..... G07C 15/001
2004/0048659 A1 * 3/2004 Seelig ..... A63F 9/30 463/25
2006/0066046 A1 * 3/2006 Okada ..... G07F 17/3251 273/144 R
2006/0151945 A1 * 7/2006 Lin ..... A63F 3/0605 273/144 R
2007/0129132 A1 * 6/2007 Seelig ..... A63F 7/048 463/16
2007/0246883 A1 * 10/2007 Cudlipp ..... G07F 17/3213 273/144 R
2009/0267302 A1 * 10/2009 Fukazawa ..... A63F 9/30 273/447
2011/0124399 A1 5/2011 Dutilly et al.
2014/0073410 A1 3/2014 Ramos et al.
2014/0156369 A1 6/2014 Circe
2014/0372192 A1 12/2014 Circe
2014/0372195 A1 12/2014 Desideri
2015/0084278 A1 * 3/2015 Walker, Jr. ..... A63F 7/2472 273/144 B
2015/0105130 A1 4/2015 McGrath et al.
2015/0105901 A1 * 4/2015 Joshi ..... G06Q 20/18 700/232
2015/0314898 A1 * 11/2015 Schwarzli ..... G07F 11/44 53/411
2016/0214424 A1 * 7/2016 Ball ..... G07F 11/005
2016/0375358 A1 * 12/2016 Shoemaker, Jr. ... G07F 17/3297 273/447
2017/0080329 A1 * 3/2017 Todokoro ..... A63F 9/30

* cited by examiner

MOBILE DEVICE-ENABLED PORTABLE REWARD DISPENSING MACHINE

BACKGROUND OF THE INVENTION

1. Field of the Invention

The present invention relates to dispensing machines, and particularly to a mobile device-enabled portable reward dispensing machine with wireless dispensing mechanisms.

2. Description of the Related Art

Mobile Phones and Tablets have been massively integrated in our lives for the past decade. So far, these devices have been utilized mostly in gaming and socializing. Numerous apps have been made to use these devices for the purpose of education and entertainment, but what lacks the most are the physical rewards, instead of game points and scores. This leads to less motivated players.

Thus, a mobile device-enabled portable reward dispensing machine solving the aforementioned problems is desired.

SUMMARY OF THE INVENTION

The mobile device-enabled portable reward dispensing machine is a portable reward or gift-dispensing machine (i.e., hardware) that is controlled by two smart phone or tablet apps/software. The integrated system is designed to reward the players of a game with gifts awarded to that specific player as a result of their game play. The dispenser is loaded with reward gifts that are capable of being dispensed through a vending or exit port under control of the two apps. The dispenser includes a microcontroller unit integrated into the dispenser and two sensors. The first of the two sensors ensures the presence of gifts within the dispensing unit available for use, while the second sensor ensures that no reward gifts are stuck at the exit door or chute. The dispenser is Wi-Fi- or Bluetooth-enabled, with direct connection to the two phone apps. The two apps work independently to assist in the proper reward gift dispensing.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
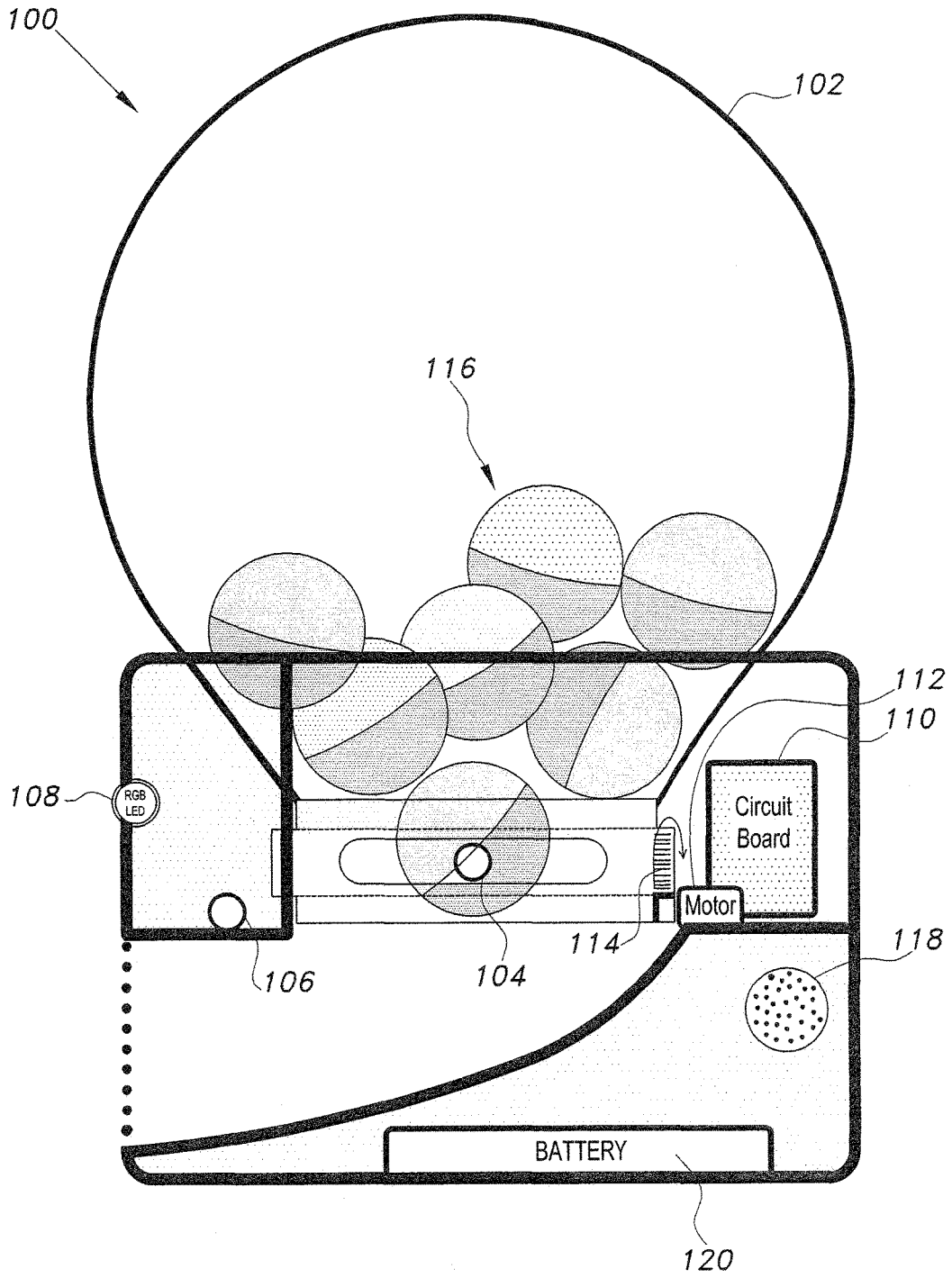
FIG. 1 is a diagrammatic front view of a mobile device-enabled portable reward dispensing machine according to the present invention.

The mobile device-enabled portable reward dispensing machine is a portable reward or gift-dispensing machine (i.e., hardware) controlled by two smart phone or tablet application programs (apps)/software. The dispensing machine 100 (shown diagrammatically in FIG. 1) is designed to reward the players of a game with gifts awarded to that specific player as a result of their game play. The dispensing machine 100 includes a container 102 that is loaded with encapsulated reward gifts 116 that are capable of being dispensed through a vending or exit port under control of the two apps. The dispensing machine 100 houses a circuit board 110, dispensing motor 112 attached to dispensing gear 114, a sound generator (e.g., a buzzer 118), a power source (such as a battery 120), an RGB LED 108, a release sensor 104, and an anti-jam sensor 106.

Figure 2:
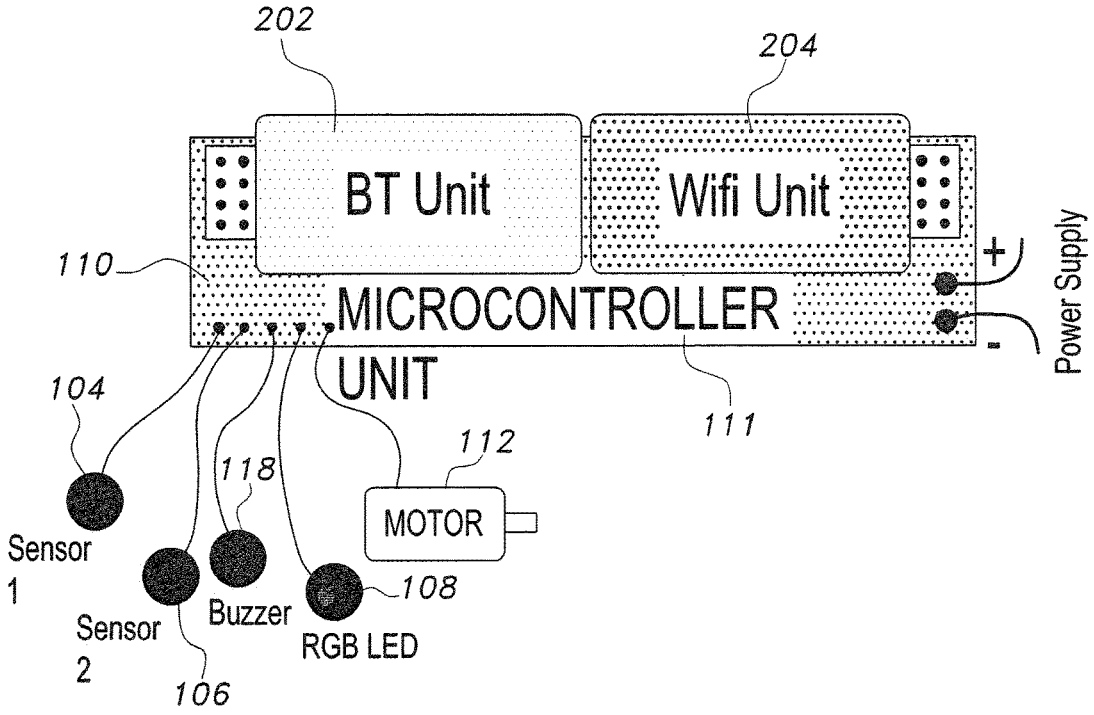
FIG. 2 is a diagram of the electronic components of a mobile device-enabled portable reward dispensing machine according to the present invention.

As shown in FIG. 2, the dispensing machine 100 includes a microcontroller unit 111 (disposed inside the dispensing machine 100) and two sensors. The first sensor is release sensor 104, which ensures the presence of gifts within the dispensing unit available for use, while the second sensor is anti jam sensor 106, which ensures that no reward gifts are stuck on the exit door or chute. The buzzer 118, sensors 104, 106, RGB LED 108, and a motor 112 are connected to and operable with the microcontroller 111. Additionally, a Bluetooth unit 202 and a Wi-Fi unit 204 are connected to and operable with the microcontroller 111. In the gift-dispensing machine 100, an LED turns ON and sounds an alarm, and as the LED blinks, the reward is mechanically dispensed. The number of times the user can press the reward button and the dispensing portion (ex. 1 press=3 gifts) are specified by the admin app.

Moreover, the release sensor 104 is at the dispensing unit to make sure that there are gifts, and to make sure they are in place. The anti jam sensor 106 is at the door of the unit to ensure no stuck gifts while the process completes. The dispensing machine 100 is Wi-Fi or Bluetooth-enabled, with direct connection to the two phone apps. The two apps work independently to assist in the proper reward gift dispensing.

Figure 3:
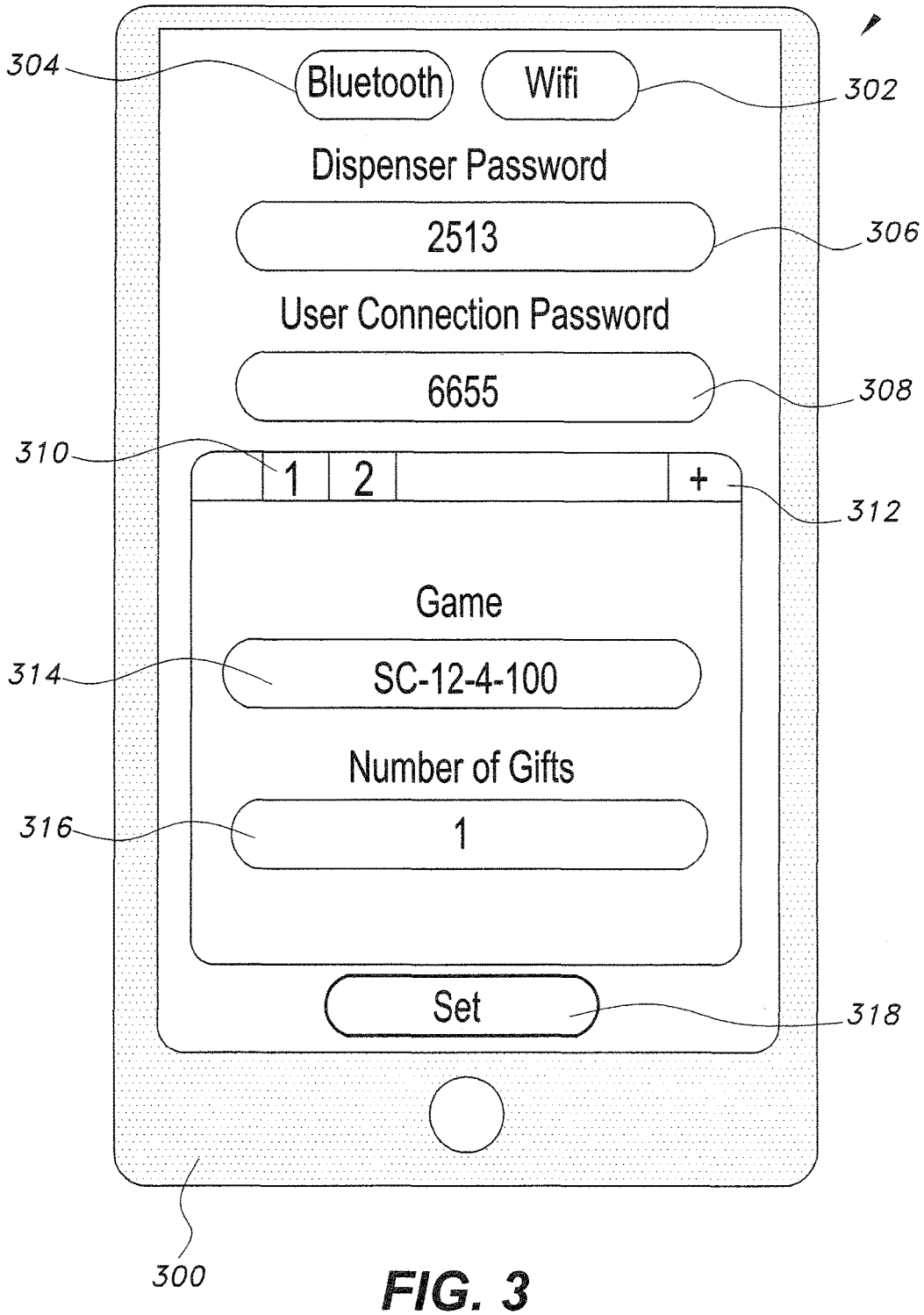
FIG. 3 is a screenshot of an exemplary examiner application for a mobile device-enabled portable reward dispensing machine according to the present invention.

The first app (user interface (UI) shown in FIG. 3) is the examiner app, where questions will be added in a predesigned gaming system. This UI provides a screen on a mobile device 300. The first app UI includes a Bluetooth select button 304, a Wi-Fi select button 302, a dispenser password entry field 306, a user connection password entry field 308, registered games tabs 310, add new game tab 312, game code field 314, number of gifts field 316, and new settings confirmation button 318. Examiners will also set the rewarding rules.

Figure 4:
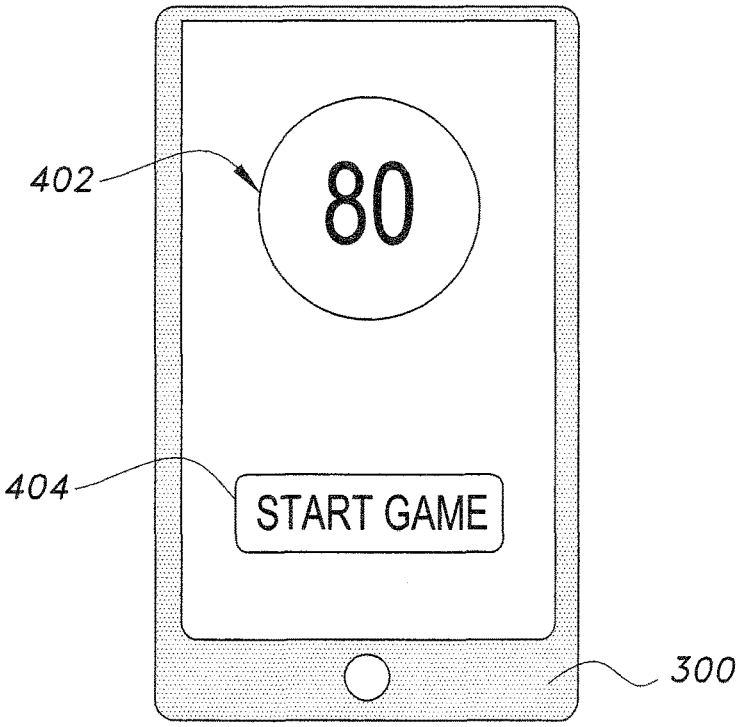
FIG. 4 is a screenshot of an exemplary start screen of a game application for the mobile device-enabled portable reward dispensing machine according to the present invention.
Figure 5:
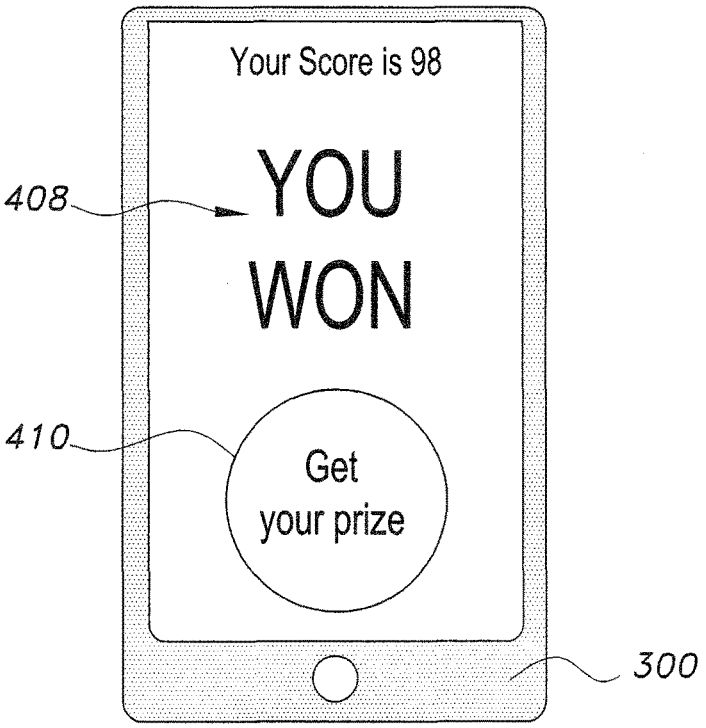
FIG. 5 is a screenshot of a winner's screen of a game application for a mobile device-enabled portable reward dispensing machine according to the present invention.
Figure 6:
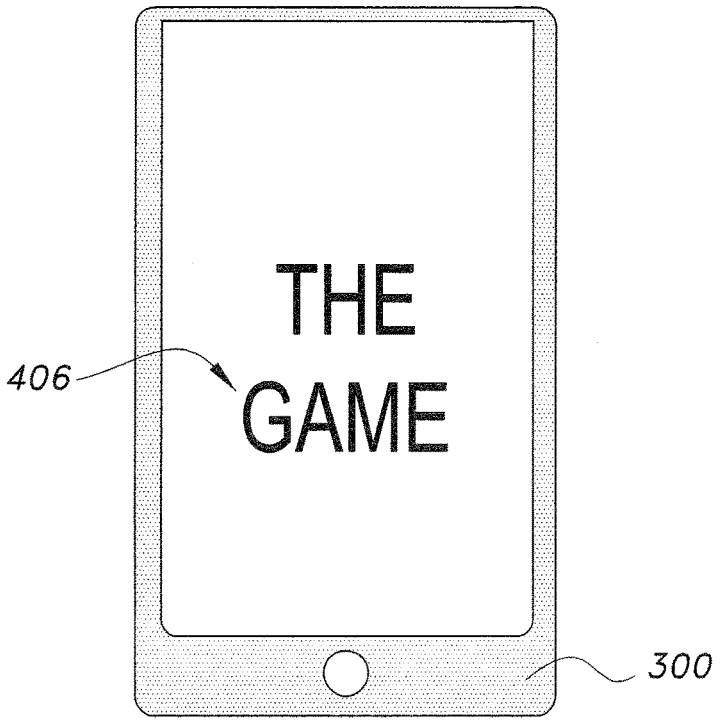
FIG. 6 is a screenshot of an exemplary opening screen of a game application for the mobile device-enabled portable reward dispensing machine according to the present invention.
Figure 7:
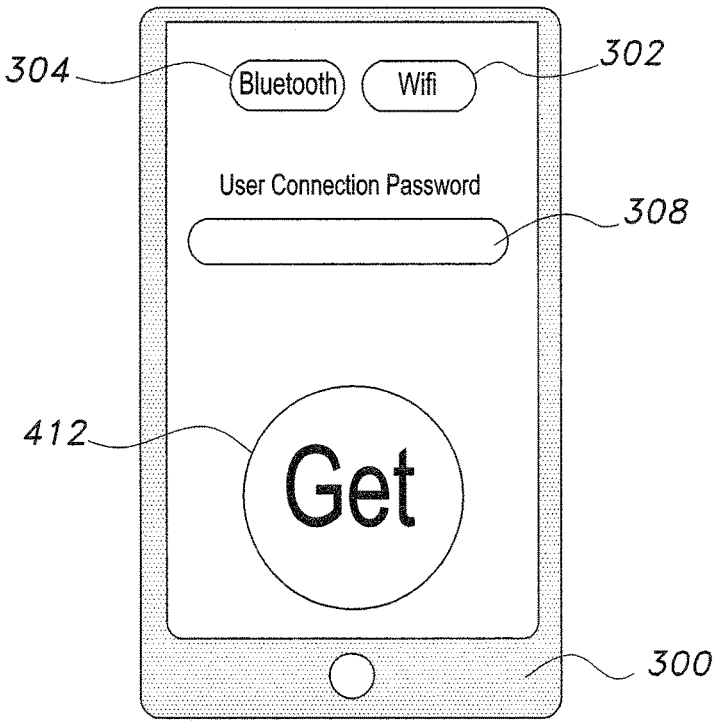
FIG. 7 is a screenshot of an exemplary network connection page of a mobile device for the mobile device-enabled portable reward dispensing machine according to the present invention.

The second app is the game, which presents a variety of screens on a mobile device 300 (such as a smartphone), wherein users will play the game through answering questions, and if the rules are met (winning the game), the smart mobile device 300 will search (through Bluetooth or Wi-Fi) for the available reward dispensing machine 100. When a successful connection is made, the app displays a reward button, which the player can use to dispense the player's reward. FIG. 4 shows an exemplary game start screen on the mobile device 300. A start game button 404 and display of the user's last score 402 are presented. FIG. 5 shows the win/loss screen on the mobile device 300. Win status field 408 is updated to reflect the user's win/loss status, which may depend on whether the user's score exceeds a win threshold. A get prize button 410 is presented when the win threshold has been exceeded. FIG. 6 shows the game screen 406 where details of the game play are presented to the user. FIG. 7 shows the game code send network connection screen, where a Bluetooth connect button 304 and a Wi-Fi connect button 302 are presented. After a user connection password has been authenticated (as entered by the user into presented field 308), the user can push the Get button 412, which is presented to facilitate sending the game code.

Figure 8:
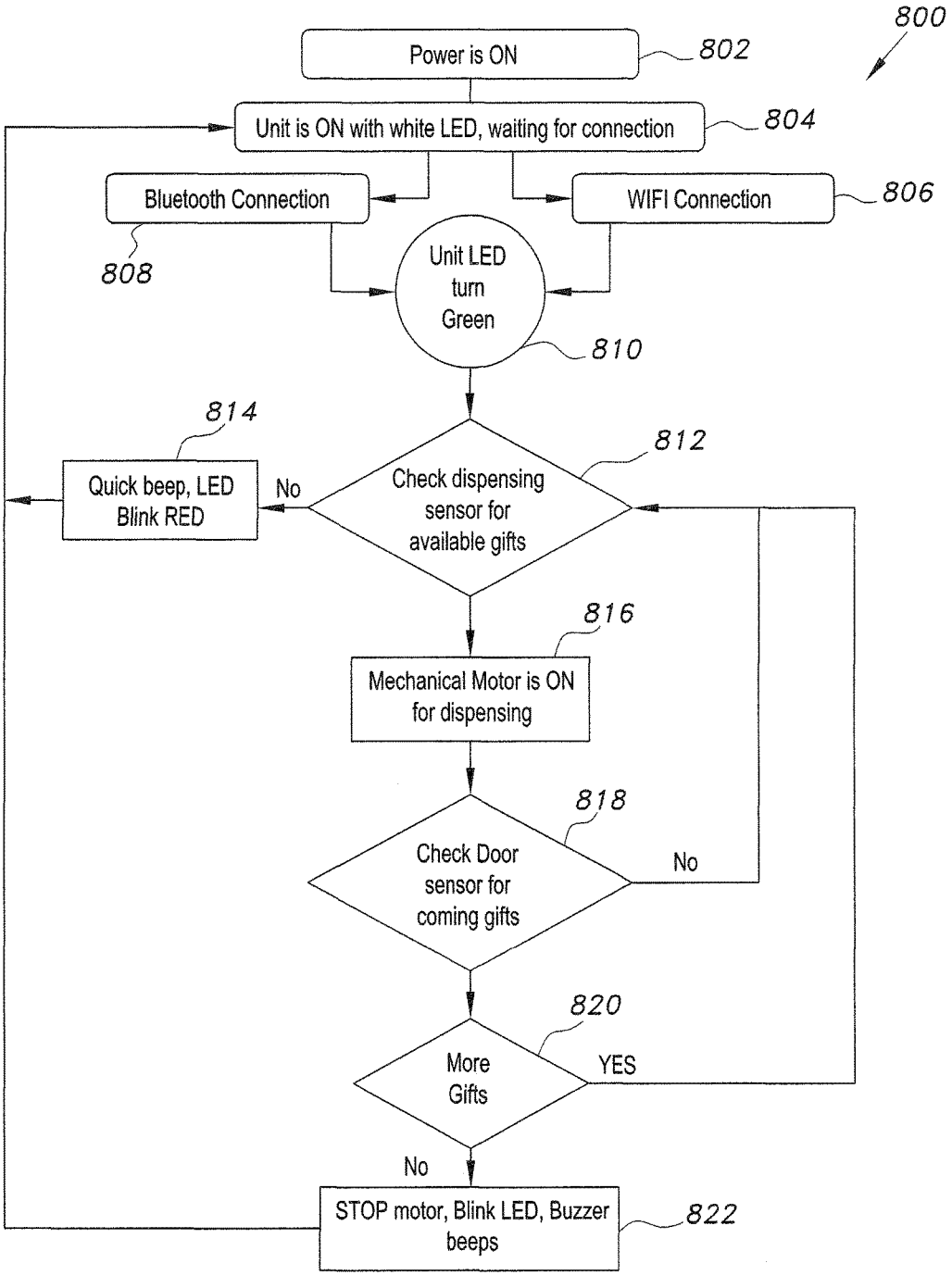
FIG. 8 is a flowchart of the microcontroller software of the mobile device-enabled portable reward dispensing machine according to the present invention.

The mobile device-enabled portable reward dispensing machine control processes 800 (shown in FIG. 8) include power up at step 802, and a color-coded LED waits for connection at step 804. After a Bluetooth connection is established at step 808, or a Wi-Fi connection is established at step 806, the color-coded LED turns green at step 810. The dispensing sensor is checked for available gifts at step 812, and the color-coded LED starts to blink red, along with an audible beep, at step 814 if no gifts are available to be dispensed. Otherwise, the mechanical motor is actuated for gift-dispensing at step 816. The dispensing door is checked using anti-jam sensor at step 818. A check is performed to determine if more gifts are available at step 820, and if they are not, the LED is set to blink, while the buzzer is set to beep at step 822.

With respect to gift-dispensing, once players achieve the rewarding score they connect to a mobile device-enabled portable reward-dispensing machine 100 and claim their reward. This dispensing of gifts is achieved by a unique mechanism designed to be smart and safe at the same time. The mobile device-enabled portable reward dispensing machine 100 is designed to dispense gifts if a player achieves the goal set by the examiner in the QHub system. The player moves in the range of the machine 100 for Bluetooth connection or connects to the machine's network for Wi-Fi connection and presses a button on their smart device, and the machine dispenses a gift. The present mobile device-enabled portable reward dispensing machine 100 is designed to be injection molded with ABS (acrylonitrile-butadiene-styrene) plastic. This reduces the developing cost, which, in turn, reduces the overall market price. This adds a significant benefit to the idea, since the integration of dispensing toys as a reward would otherwise be out of reach of schools or the common man due to its cost. It is small in size, with roughly the dimensions of 400×200 mm. Since the material being used is plastic, the weight of the system is just over 1 kg.

Figure 9:
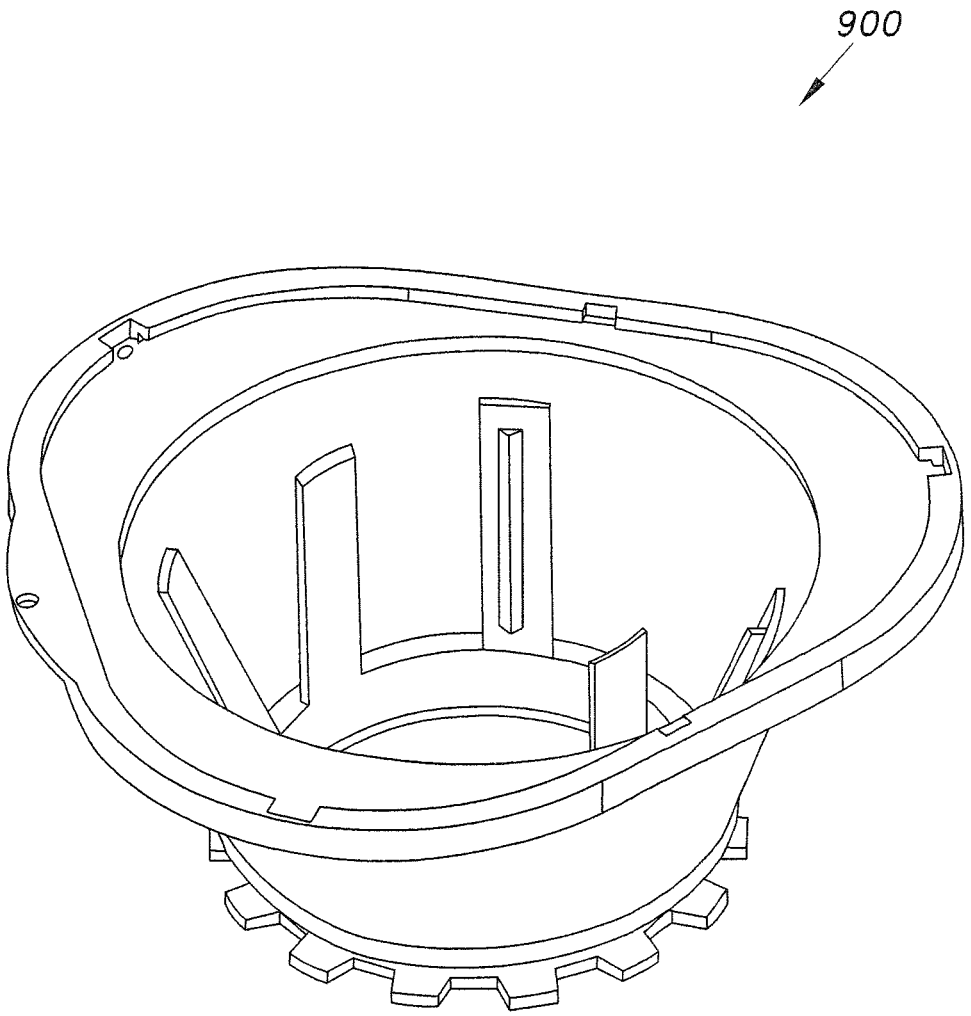
FIG. 9 is a perspective view of a dispenser cone for a mobile device-enabled portable reward dispensing machine according to the present invention.
Figure 10:
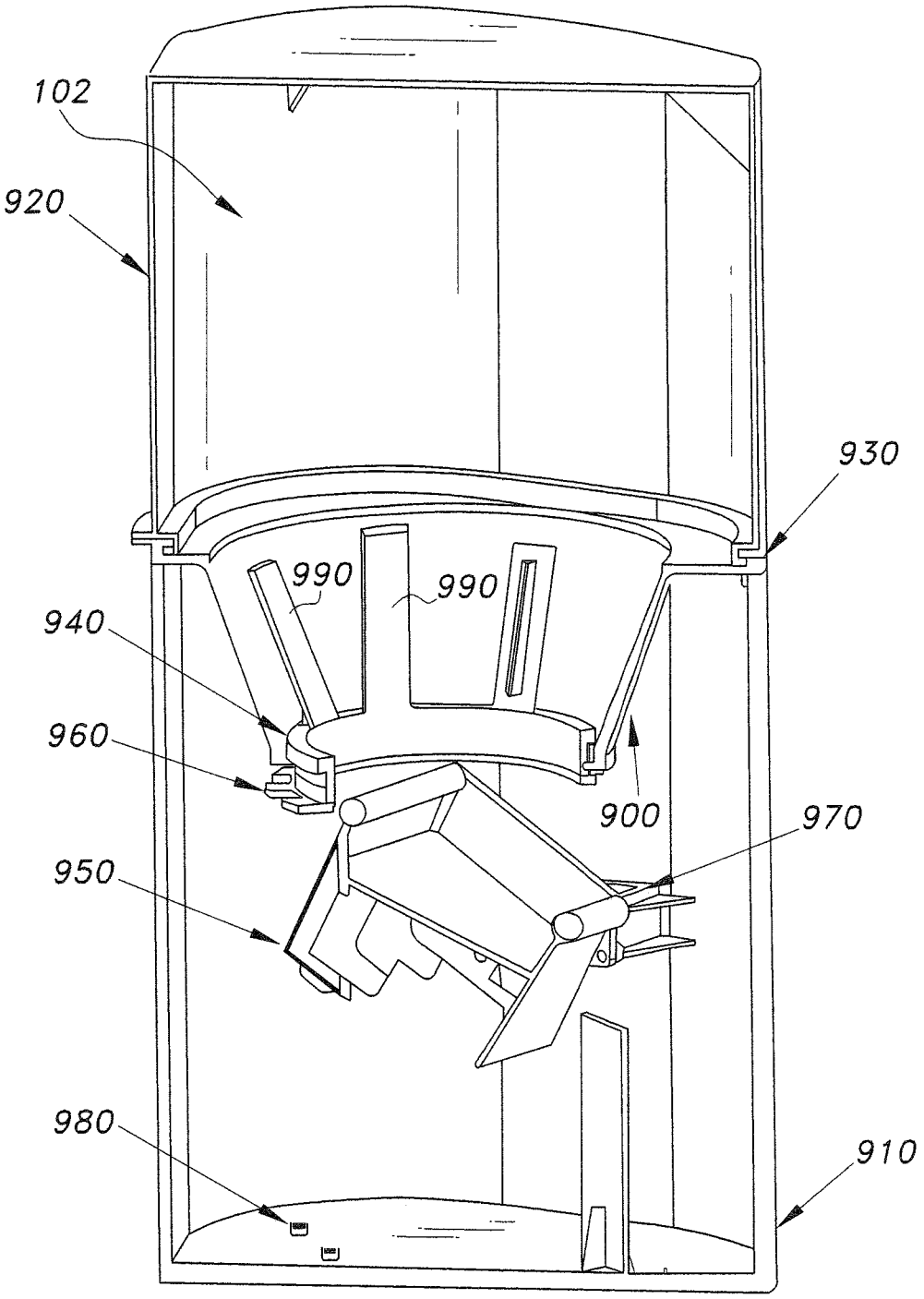
FIG. 10 is a diagrammatic front view in section view of a dispenser chamber for a mobile device-enabled portable reward dispensing machine according to the present invention.

Since the target consumers are children, the system is designed to be safe enough for children. This was made sure by avoiding sharp edges, small pieces that could be swallowed (presenting a choking hazard), and an overall rigid assembly. An enhanced mechanism was developed to allow the dispensing of the toy capsules. The drop of the toy capsules is one of the most important aspects of a dispensing machine. The plate holding the toy capsules is usually inclined to allow a smooth drop. This method is gravity-dependent. Due to the lightweight capsules, this does not provide 100% repeatability. Thus, a new method was introduced to solve the given problem. As shown in FIG. 9, the present dispenser includes an inner frustoconically shaped dispensing member, with a structure similar to that of a fan. This inner dispensing member rests upon an outer dispensing member, and is free to rotate. The movement of this inner dispensing member allows the capsules to move if they are stuck. This method is not dependent on the weight of the capsule, nor is it dependent on its shape, thus adding flexibility to the design and allowing 100% repeatability. But adding another rotation adds on more cost due to the addition of a motor. The present design is tailored so that only one motor is used for both the holder and rotation of the cone. As shown in FIG. 10, the dispenser member is disposed inside the dispenser chamber 102. The mechanical dispensing unit comprises a bottom base 910 and a top cover 920 that is removable to add capsules filled with a prize or prizes. A frustoconically shaped incline cone 930 is a reward capsule guiding mechanism that converges the downward travel of the capsules towards the dispensing cup 950. An inner cone 940 having elongate planar extensions 990 functions as a capsule shuffler operable before and after each dispensing to avoid capsule jamming. A dispensing cup 950 functions as a single capsule rotator that rotates a single capsule to eject the capsule from the dispensing machine. An incline gear 960 connects the dispensing cup 950 to the inner cone 940. This way only one motor 970 is required for the two rotational motions, i.e., the dispensing of the capsule from the dispensing cup 950 and the stored capsule shuffle provided by the inner cone 940 to avoid a jam. The motor 970 is connected to the dispensing cup 950. A PCB holder 980 attaches the PCB to the base 910.

Figure 11:
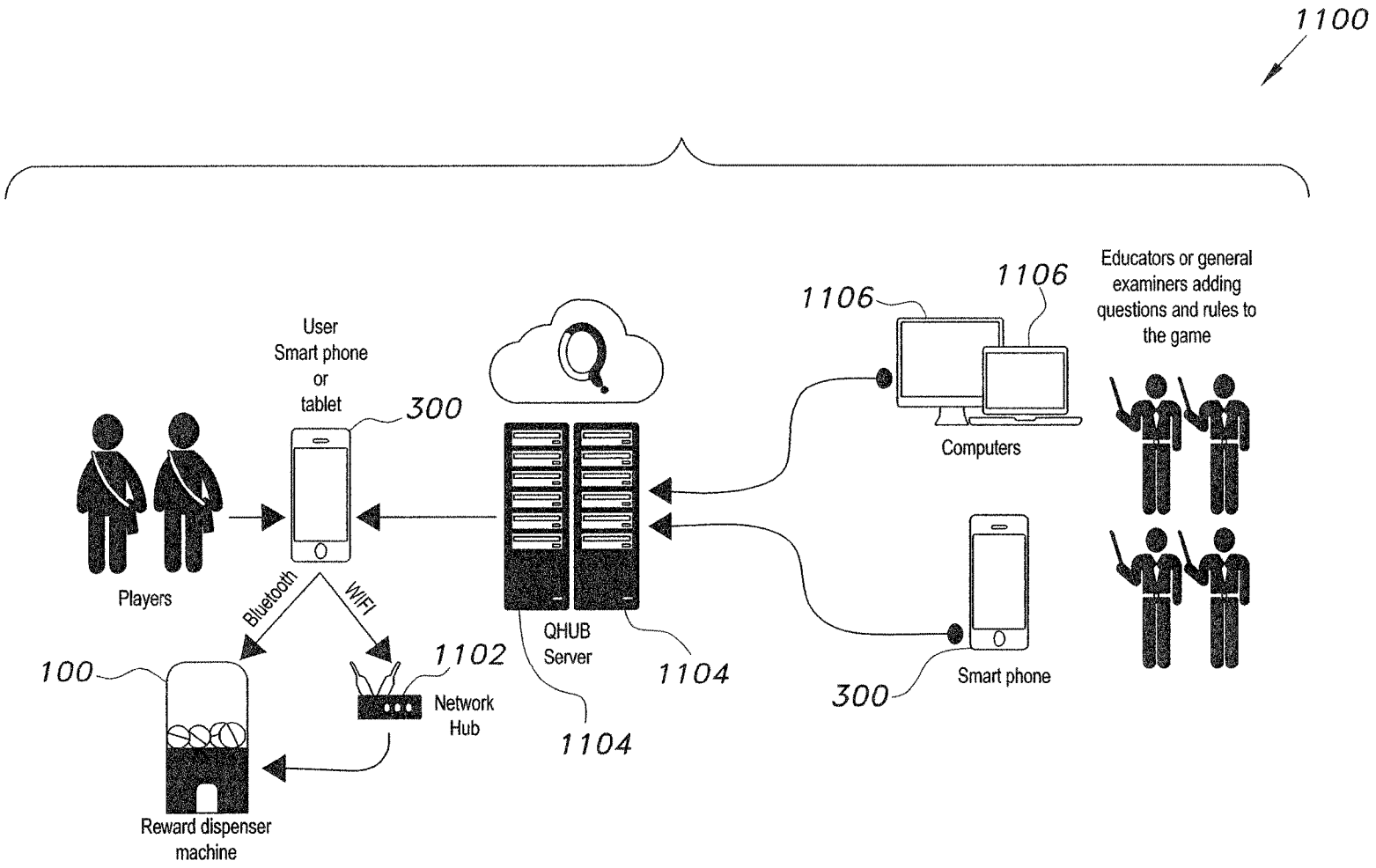
FIG. 11 is a schematic diagram of a wireless network for a mobile device-enabled portable reward dispensing machine according to the present invention.

As shown in FIG. 11, the entire system 1100 includes players using smart phones connected by Bluetooth or by wireless local area network (Wi-Fi) via a network hub 1102 to a mobile device-enabled portable reward dispensing machine 100. A hub server 1104 mediates possible transactions between the users' smart phones 300 and the mobile device-enabled portable reward dispensing machine 100. The hub server 1104 is administered by educators or general examiners adding questions and rules to the game. The administration may be facilitated via connection of computers and smartphones to the hub server 1104.

Figure 12:
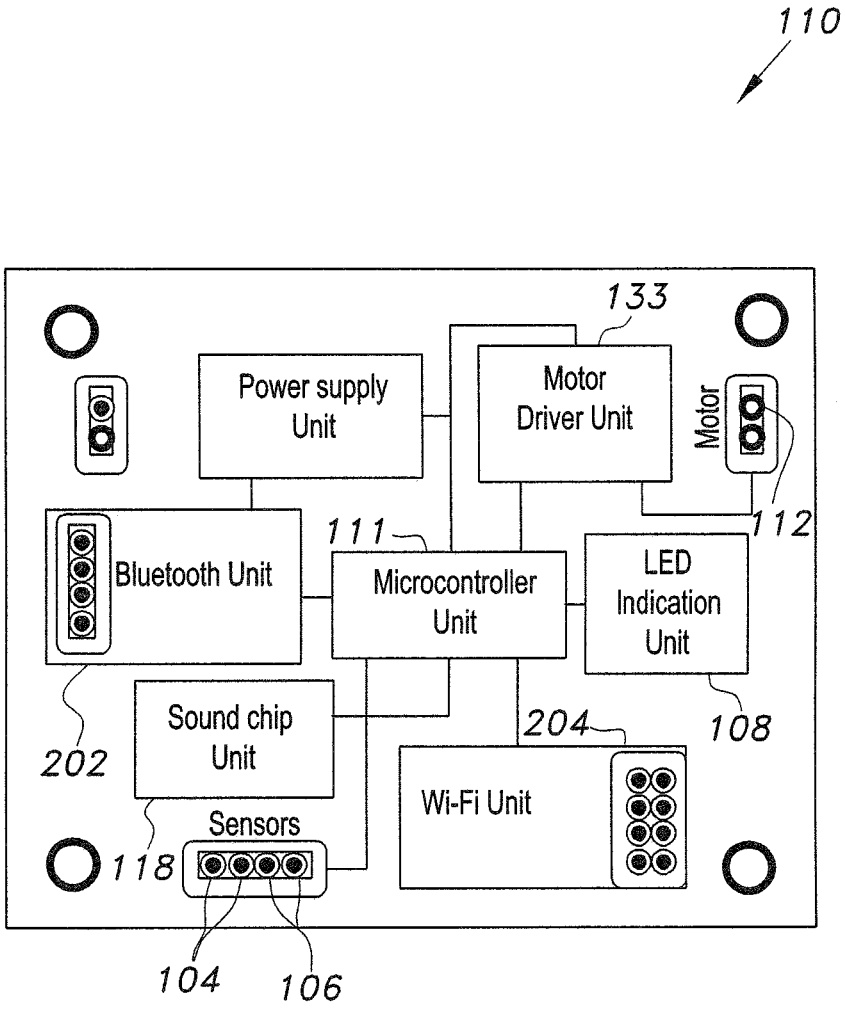
FIG. 12 is a block diagram of the dispensing machine, according to the present invention.

The electronics disposed on the circuit board 110 are designed for great flexibility and security and, as shown in FIG. 12, the mobile device-enabled portable reward dispensing machine's PC board is provided with many extension slots for future advancements. The Bluetooth unit 202 can be, for example, a low energy Bluetooth (BLE) technology module (HM-10). This allows both android and iOS devices to get connected seamlessly. BLE uses much less power than typical Bluetooth units, and it won't affect the battery backup duration of the connected mobile device.

The Wi-Fi unit 204 adds more connectivity options to the device. A desktop device or any device that is connected to the Wi-Fi network may be used. Multiple users can connect at the same time, and the gaming process will become more interesting.

An indication unit includes LED indicators (RGB LED 108) and at least one sound indicator (buzzer 118). Multiple color LEDs are used for a better user experience. It can easily indicate the present status of the system by color changes. The buzzer 118 may comprise a sound chip with speakers, which enhance the user's experience. Pre-stored voice messages make the users, i.e., game participants, more enthusiastic and energetic.

The power supply unit 120 is capable of providing sufficient current and rated voltages for other units. It includes 3.3V and 5V regulators. The motor driver unit 133 is used to control the mechanical movement for dispensing the gifts. Since microcontrollers are not good to control motors directly, the present mobile device-enabled portable reward dispensing machine 100 uses motor drivers. This increases the stability of the system.

The microcontroller unit is programmed in such a way that it is capable of handling all security options, communication protocols, and proper interactions with other units. The EEPROM is efficiently used to retain all the information, even if the device is turned off. An Atmel®Atmega32 is a reduced instruction set computer (RISC), which easily meets the computational requirements of the system. With respect to sensors, the hardware has the provision to connect multiple sensors to the system. This guarantees dispensing of the gift. Multiple sensors are used to make the system extremely reliable.

The present mobile device-enabled portable reward dispensing machine 100 is a small portable system that provides a gaming-based reward system with no user database. There is no manual dispensing, as the system is controlled by smart phone and tablets. There exists a direct connection to the mobile device-enabled portable reward dispensing machine 100 over Bluetooth or Wi-Fi. The present dispensing machine 100 utilizes no direct money payment, as it is not a vending system. The programmable microcontroller unit is operable with the Wi-Fi, BT, Sensor, Motor, and Buzzer. The two sensors ensure correct dispensing.

It is to be understood that the present invention is not limited to the embodiments described above, but encompasses any and all embodiments within the scope of the following claims.

I claim:

1. In combination, a mobile device and a mobile device-enabled portable reward dispensing machine, comprising:

a housing including a container for holding game reward capsules;

a frustoconically shaped game reward capsule guiding dispenser disposed inside the container, the capsule guiding dispenser including an inner cone having elongate planar extensions about its inner surface and converging downwardly;

at least one wireless receiver disposed inside the housing;

a dispensing cup operationally connected to the inner cone, the inner cone being dimensioned and configured for converging downward travel of the reward capsules towards the dispensing cup;

an incline gear connecting the dispensing cup to the inner cone;

a motor connected to the dispensing cup and to the inner cone, the motor providing rotational motion to the dispensing cup and to the inner cone so that the inner cone shuffles the capsules in order to avoid a jam during dispensing of the game reward capsules;

an automated capsule-dispensing controller disposed inside the housing, having:

an actuator for releasing at least one capsule from the container when activated;

at least one wireless receiver;

a microcontroller circuit connected to the actuator and the at least one wireless receiver, the microcontroller being configured for activating the actuator when the wireless receiver receives a "game won" capsule release wireless signal from a user;

the mobile device having at least one executable game software application, the at least one executable game software application having stored thereon a set of instructions for performing game implementation, the instructions including:

a first set of instructions for playing a game on the mobile device;

a second set of instructions, wherein the second set of instructions includes instructions for establishing connection with the wireless receiver, authenticating the game playing on the mobile device with the wireless receiver, and indicating whether at least one capsule is present in the holding container;

a third set of instructions for determining a score achieved by a player of the game;

a fourth set of instructions for determining a score including at least a plurality of questions to be answered, grading any answers submitted, and tallying a value for the correct answers given to establish an immediate game score; and a fifth set of instructions for initiating the capsule release signal from the mobile device only when the immediate game score exceeds a threshold value.

2. The mobile device-enabled portable reward dispensing machine according to claim 1, further comprising a first sensor disposed inside the container, the first sensor sensing whether any reward capsules are present in the container, the first sensor being connected to said microcontroller.

3. The mobile device-enabled portable reward dispensing machine according to claim 2, further comprising a second sensor disposed proximate an exit path of the game reward capsule guiding mechanism, the second sensor sensing whether any reward capsule is stuck in a position that blocks the exit path, the second sensor being connected to said microcontroller.

4. The mobile device-enabled portable reward dispensing machine according to claim 3, further comprising a first visual indicator disposed on the dispensing machine, the first visual indicator being in operable communication with the first sensor to visually indicate when no reward capsule is present in the container.

5. The mobile device-enabled portable reward dispensing machine according to claim 3, further comprising a sound generator disposed on the dispensing machine, the sound generator being in operable communication with the first sensor to audibly indicate when no reward capsule is present in the container.

6. The mobile device-enabled portable reward dispensing machine according to claim 5, further comprising an admin server in operable communication with the mobile device, the admin server including, responsive to administrator input.

* * * * *